US009779713B2

(12) United States Patent
Blanc et al.

(10) Patent No.: US 9,779,713 B2
(45) Date of Patent: Oct. 3, 2017

(54) ACOUSTIC METAMATERIAL GATE

(71) Applicant: United Technologies Corporation, Farmington, CT (US)

(72) Inventors: Arthur Blanc, Providence, RI (US); Joseph V. Mantese, Ellington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 376 days.

(21) Appl. No.: 14/614,557

(22) Filed: Feb. 5, 2015

(65) Prior Publication Data

US 2016/0189702 A1 Jun. 30, 2016

Related U.S. Application Data

(60) Provisional application No. 62/096,686, filed on Dec. 24, 2014.

(51) Int. Cl.
*G10K 11/00* (2006.01)
*G10K 11/04* (2006.01)

(52) U.S. Cl.
CPC ..... *G10K 11/04* (2013.01)

(58) Field of Classification Search
CPC ..... G10K 11/04; G10K 11/18; G10K 11/26
See application file for complete search history.

(56) References Cited

U.S. PATENT DOCUMENTS

2004/0047485 A1* 3/2004 Sherrit ..... B06B 3/00 381/340
2007/0258328 A1* 11/2007 Zlotnik ..... G10K 15/04 367/139
2012/0101495 A1* 4/2012 Young ..... A61B 17/29 606/41
2013/0025961 A1* 1/2013 Koh ..... F16F 15/02 181/207
2015/0088154 A1* 3/2015 Vaitekunas ..... A61B 17/12 606/128

* cited by examiner

*Primary Examiner* — Hovhannes Baghdasaryan
(74) *Attorney, Agent, or Firm* — Cantor Colburn LLP

(57) ABSTRACT

An acoustic wave gate is provided. The gate includes one or more layers of metamaterial configured to be in a first state and a second state and configured to change from the first state to the second state when electrical and/or magnetic energy is applied thereto. The gate also includes at least one source configured in operational communication with the one or more layers and configured to supply at least one of electrical and magnetic energy to the one or more layers. The one or more layers are configured to (i) prevent the passage of acoustic energy through the one or more layers when in the first state and (ii) permit the passage of acoustic energy through the one or more layers when in the second state, wherein the one or more layers are configured to be stimulated in phase with the acoustic energy.

20 Claims, 7 Drawing Sheets

ACOUSTIC METAMATERIAL GATE

CROSS REFERENCE TO RELATED APPLICATIONS

This application claims the benefit of an earlier filing date from U.S. Provisional Application Ser. No. 62/096,686, filed Dec. 24, 2014, the entire disclosure of which is incorporated herein by reference.

BACKGROUND OF THE INVENTION

The embodiments herein generally relate to acoustic wave generation and more particularly to coherent acoustic wave generation by electrically stimulated non-linear materials and acoustic gates configured to control transmission of acoustic waves.

Unlike light amplification by stimulated emission of radiation ("LASER") devices, acoustic waves traditionally are focused using high power, large system techniques. The ability to send and receive focused acoustic radiation over 100s to 1000s of meters currently requires large parabolic acoustic dishes that, at best, focus incoherent acoustic radiation into a solid angle about the direction of desired propagation. Alternatively, planar phased-arrays may be used to produce intense directional acoustic radiation.

BRIEF DESCRIPTION OF THE INVENTION

According to one embodiment, an acoustic wave gate is provided. The acoustic wave gate includes one or more layers of metamaterial configured to be in a first state and a second state and configured to change from the first state to the second state when electrical and/or magnetic energy is applied thereto. The acoustic wave gate also includes at least one source configured in operational communication with the one or more layers and configured to supply at least one of electrical and magnetic energy to the one or more layers. The one or more layers are configured to (i) prevent the passage of acoustic energy through the one or more layers when in the first state and (ii) permit the passage of acoustic energy through the one or more layers when in the second state, wherein the one or more layers are configured to be stimulated in phase with the acoustic energy.

In addition to one or more of the features described above, or as an alternative, further embodiments may include one or more electrodes disposed between the one or more layers, the one or more electrodes in electrical communication with the at least one source, and the one or more electrodes configured to provide the operational communication between the at least one source and the one or more layers.

In addition to one or more of the features described above, or as an alternative, further embodiments may include, wherein the one or more layers comprise an electromechanical material.

In addition to one or more of the features described above, or as an alternative, further embodiments may include, wherein at least one layer of the one or more layers comprises a piezoelectric ceramic or a piezoelectric crystal.

In addition to one or more of the features described above, or as an alternative, further embodiments may include, wherein the one or more layers comprise a plurality of layers configured into cells.

In addition to one or more of the features described above, or as an alternative, further embodiments may include, wherein the metamaterial comprises at least one of a matrix of cells and a lattice structure.

In addition to one or more of the features described above, or as an alternative, further embodiments may include an acoustic wave generator configured in acoustic communication with the gate and configured to transmit acoustic energy through the gate when the gate is in the second state.

In addition to one or more of the features described above, or as an alternative, further embodiments may include, wherein the one or more layers are configured to reflect acoustic energy that is incident to the layers.

In addition to one or more of the features described above, or as an alternative, further embodiments may include an acoustic horn disposed adjacent to the one or more layers and configured to modify an acoustic impedance of acoustic energy that is transmitted through the acoustic gate.

In addition to one or more of the features described above, or as an alternative, further embodiments may include, wherein the acoustic horn is configured to match an impedance of the acoustic energy transmitted through the gate with an impedance of a material into which the acoustic energy is to be transmitted.

In addition to one or more of the features described above, or as an alternative, further embodiments may include, wherein the one or more layers are configured to operate as an acoustic horn.

In addition to one or more of the features described above, or as an alternative, further embodiments may include at least one third state of the one or more layers of metamaterial configured to enable amplitude modulation of acoustic energy that passes through the one or more layers.

In addition to one or more of the features described above, or as an alternative, further embodiments may include one or more mechanical and/or electrical dissipation circuits configured to control energy leakage through the gate.

According to another embodiment, a method of transmitting acoustic energy is provided. The method includes generating acoustic energy with an acoustic energy source, blocking the generated acoustic energy from leaving the acoustic energy source with an acoustic gate in a first state, and controlling the acoustic gate to change to a second state that permits the acoustic energy to pass through the acoustic gate and be emitted to an environment.

In addition to one or more of the features described above, or as an alternative, further embodiments may include, wherein the acoustic gate is formed from metamaterials.

In addition to one or more of the features described above, or as an alternative, further embodiments may include, during the blocking step, reflecting the acoustic energy back into the acoustic energy source.

In addition to one or more of the features described above, or as an alternative, further embodiments may include altering the acoustic impedance of the acoustic energy to match an acoustic impedance of a material into which the acoustic energy is to be transmitted.

In addition to one or more of the features described above, or as an alternative, further embodiments may include modulating the amplitude of the acoustic energy prior to emission of the acoustic energy.

In addition to one or more of the features described above, or as an alternative, further embodiments may include, wherein the step of modulating includes a state of operation that is between the first state and the second state.

In addition to one or more of the features described above, or as an alternative, further embodiments may include dampening energy leakage through the gate.

Technical features of the invention include providing an acoustic gate configured to selectively prevent or permit the transmission of acoustic energy from a generator. Further technical features of the invention include providing an acoustic gate formed of a periodic structure that prevents propagation of acoustic energy through the material due to a selective change in the bulk modulus of the material of the acoustic gate.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
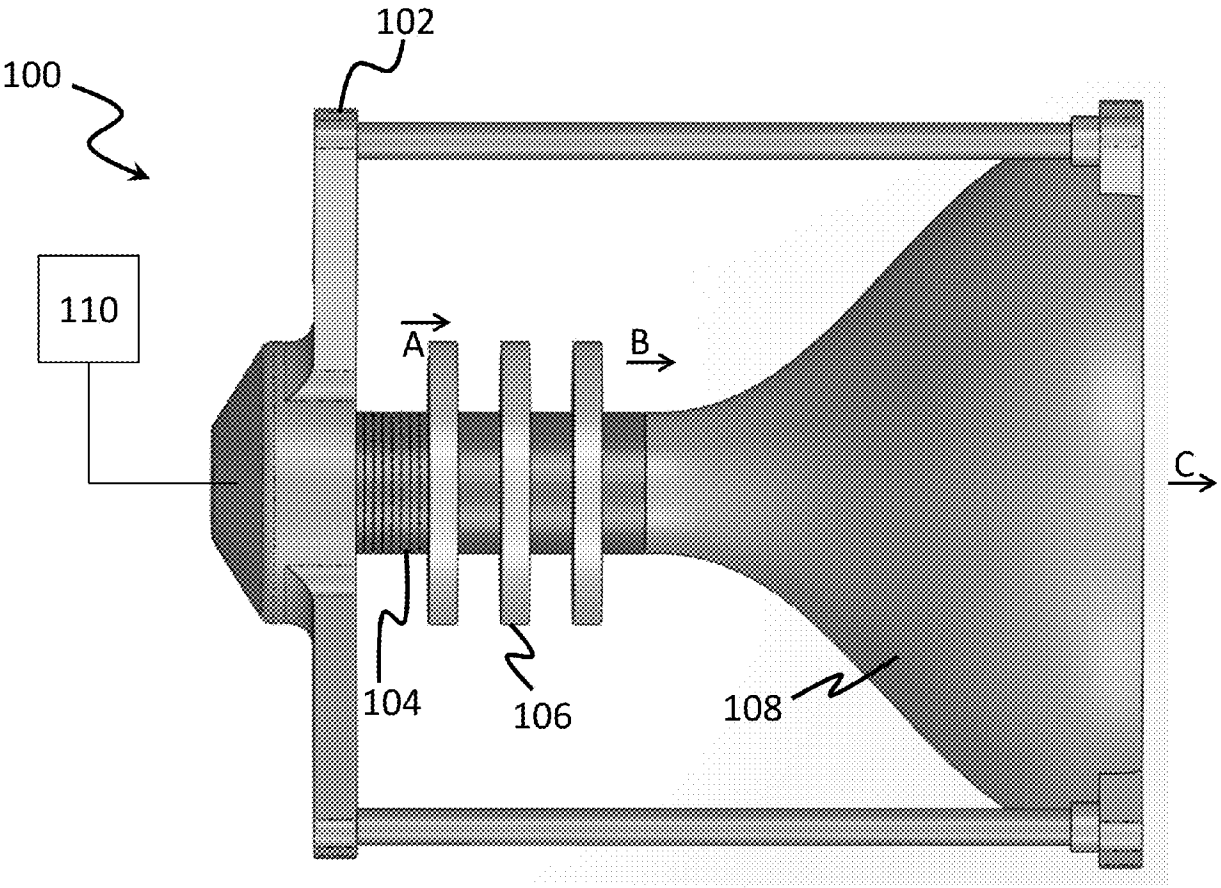
FIG. 1 shows a schematic of an acoustic wave generator in accordance with an exemplary embodiment of the invention.

Referring to FIG. 1, a schematic of an acoustic wave generator 100 in accordance with an exemplary embodiment of the invention is shown. Acoustic wave generator 100 includes three general components housed or supported within a frame 102 or other structure, such as a housing, enclosure, etc. A first component is an acoustic actuator, generator, transducer, or other similar device, hereinafter acoustic generator 104. A second component is an acoustic gate 106. A third component is an acoustic horn 108. Generally speaking, the acoustic generator 104 is configured to generate a source of acoustic energy, which then transfers or travels through the gate 106 (when the gate is open), and finally is amplified or altered in horn 108, and transmitted from the acoustic wave generator 100. In order to generate sufficient energy for acoustic wave generation and transmission, energy is contained, stored, and/or amplified within the acoustic generator 104 prior to opening of the gate 106. Those of skill in the art will appreciate that the acoustic horn 108 may be optional, and an acoustic wave generator in accordance with the present disclosure may be formed with only an acoustic actuator and an acoustic gate.

The acoustic generator 104 generates acoustic energy using low instantaneous electrical power and stores the generated acoustic energy until sufficient energy is available to emit a high power acoustic pulse. Synchronous excitation is employed to accumulate energy at resonance within the acoustic generator 104. To achieve this, the acoustic generator 104 may be formed as an acoustic transducer. In such an exemplary configuration, the acoustic transducer minimizes electrical power requirements by storing and quickly releasing acoustic energy. To perform the charge and discharge function, the acoustic wave generator 100 includes: the acoustic generator 104, which, for example, may be configured as a generator that transforms electrical power into coherent acoustic energy, and also can gradually build up and store the generated energy; the gate 106, which, for example, may be configured as a metamaterial gate that enables the storage within the acoustic generator 104 or the release of acoustic energy by forming a reflective or transmissive medium or interface depending on the state of the gate 106; and the optional acoustic horn 108 which may be configured to match the acoustic impedance between the acoustic wave generator 100 (emitting medium) and the environment in which acoustic energy is to be radiated (receiving medium), and therefore maximize energy transfer or transmission.

As used herein, metamaterials that may be used to form the gate, or other components of the acoustic wave generator, may be artificial materials engineered to have properties that have not yet been found in nature. For example, the materials may be assemblies of multiple individual elements fashioned from conventional materials such as metals or plastics, but the materials are usually constructed into repeating patterns, often with microscopic structures. Various shapes, geometries, sizes, orientations, and/or arrangements of the metamaterials can be configured to modify acoustic energy in a manner not observed in natural materials. These metamaterials achieve desired effects by incorporating structural elements of sub-wavelength sizes, i.e., features that are smaller than the wavelength of the waves they affect. Thus, those of ordinary skill in the art will appreciate the various configurations and selections for metamaterials that are appropriate to form an acoustic gate or the other various components described herein. Further, the metamaterials employed herein may be used to form one-, two-, three-, or other-dimensional structures for the gates and other aspects of the acoustic wave generator, as will be appreciated by those of skill in the art.

An exemplary embodiment of the acoustic generator 104 may be built as stacked layers of strain mismatched piezoelectric ceramics or crystals with interleaving electrical layers, as described below. Acoustic wave generators in accordance with various embodiments disclosed herein, such as acoustic wave generator 100, are capable of producing amplified coherent sound through a non-linear high gain medium consisting of bi-or-multi-layers of piezoelectric ceramic crystal sandwiches formed with interfacial strain for non-linearity and incorporating interleaving electrodes. In accordance with some embodiments, when the acoustic generator 104 is driven by a series of external electrical oscillators, the acoustic energy is phase separated in such a manner that an acoustic wave is phase matched between various layers of the acoustic generator 104. As a result, the acoustic energy may be amplified, thus requiring little energy input for a relatively large energy generation or output. During and after generation, the acoustic energy or waves are maintained in an acoustic cavity, which may be formed by the acoustic generator 104 when the gate 106 is in a closed state. Transmission from the acoustic generator 104 occurs when the gate 106 is opened and the acoustic energy is transferred or transmitted through and out of the acoustic horn 108. As such, energy generally flows, as indicated by the arrows A, B, and C, from left to right in FIG. 1, starting at the acoustic generator 104, passing into and through the gate 106 in direction A, into the horn 108 in direction B, and exiting the acoustic wave generator 100 through horn 108 in direction C. However, when the acoustic gate 106 is closed, the energy may be confined within the acoustic generator 104 because the energy is reflected back into the acoustic generator 104 at the interface between the acoustic generator 104 and the acoustic gate 106.

As shown in FIG. 1, a controller 110 may be operationally connected to the acoustic wave generator 100. The controller 110 may include one or more processors and/or memory devices configured to store and execute control algorithms and functions. As such, the controller 110 may be configured to provide operational control over the acoustic wave generator 100. The controller 100 may be configured to control one or more components of the acoustic wave generator 100, such as controlling the acoustic generator 104, the gate 106, and/or the horn 108.

Figure 2:
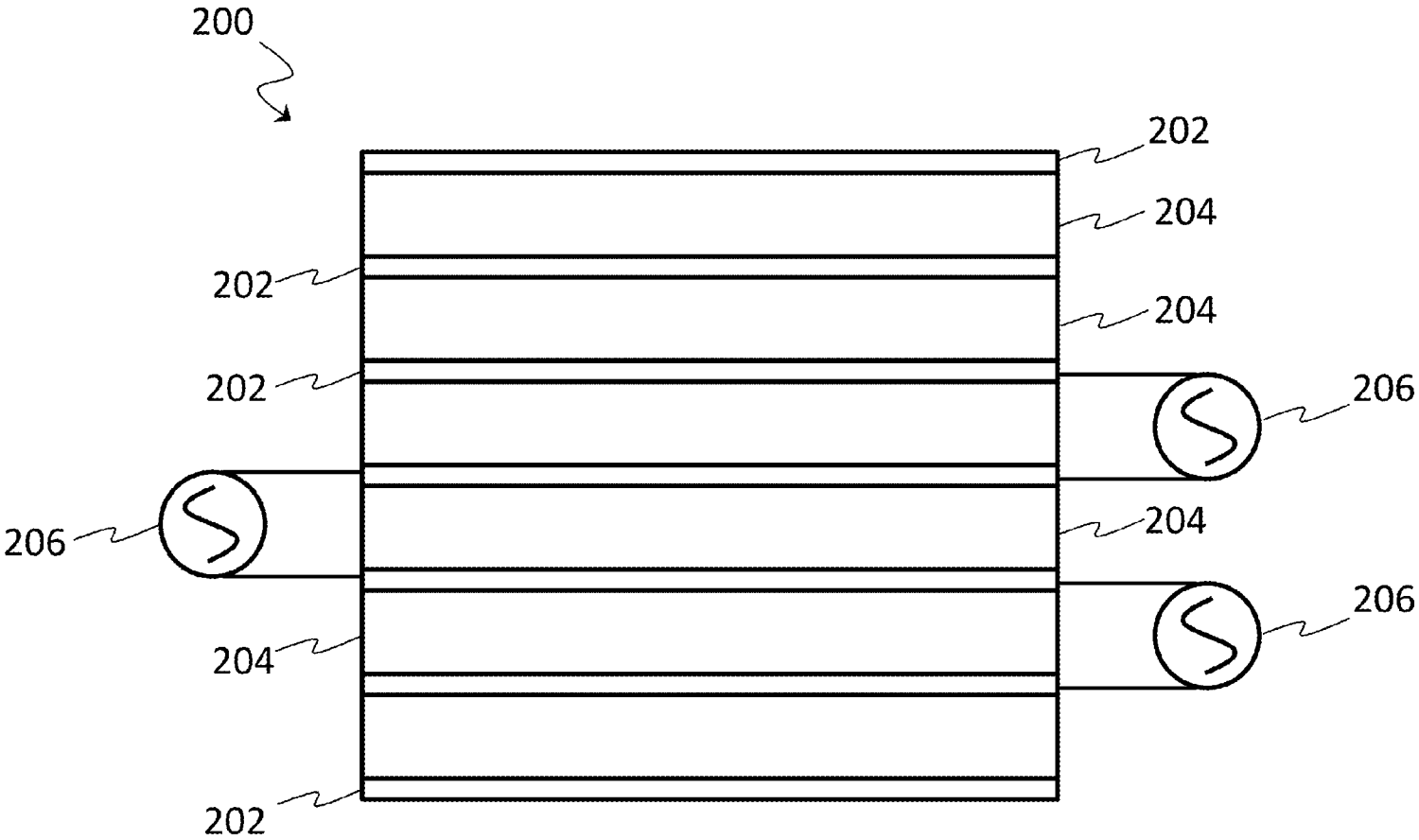
FIG. 2 shows a schematic of an acoustic generator in accordance with an exemplary embodiment of the invention.

Turning now to FIG. 2, a schematic of an acoustic generator 200 in accordance with an exemplary embodiment is shown. The acoustic generator 200 may require electronics to drive and control the device, for example to generate and store acoustic energy therein. For example, the acoustic generator 200 is a generator of acoustic waves that is configured to convert electrical energy into mechanical energy and configured to amplify and/or store the converted mechanical energy within the acoustic generator 200. Thus, acoustic generator 200 is not only a generator but also an acoustic energy amplifier and/or storage cavity or device.

To achieve acoustic energy generation, amplification, and storage, the acoustic generator 200 is formed as a stack that includes a plurality of first layers 202 that are sources of electrical or magnetic energy, such as electrodes, and a plurality of second layers 204 that are formed from materials that can change mechanical properties by application of electrical and/or magnetic energy, such as piezoelectric ceramics and/or crystals or magnetostrictive materials, though not limited thereto. The second layers 204 are configured or selected to change mechanical properties when an external energy or power is applied thereto, such as by converting electrical and/or magnetic energy into kinetic energy. For example, the second layers 204 may be configured to convert electrical and/or magnetic energy to kinetic energy by changing shape and/or size when the electrical and/or magnetic energy is applied to the material of the second layers 204. Thus acoustic generator 200 generates acoustic energy (kinetic energy) through electromagnetic actuation of the second layers 204. The plurality of first layers 202 and the plurality of second layers 204 form bi-or-multi-layer sandwiches or a stack of layers. The application of electrical and/or magnetic energy to the second layer 204 through first layer 202 causes the second layer 204 to actuate and/or change mechanical properties, and the change in mechanical properties generates acoustic energy, such as in the form of vibrations (kinetic energy) within the material of the second layers 204.

As shown schematically in FIG. 2, a number of oscillators 206 are connected to the electrode first layers 202. Although shown with only three oscillators 206, those of skill in the art will appreciate that different numbers and configurations of oscillators may be provided without departing from the scope of the invention. Further, although shown as oscillators, those of skill in the art will appreciate that other types of energy, power, and/or control may be employed without departing from the scope of the invention.

By applying synchronized time varying signals from the oscillators 206 at each electrode first layer 202 an acoustic field and/or waveform in the acoustic generator 200 can be created and manipulated. By selecting a driving frequency corresponding to a resonance of the stack of the acoustic generator 200, and by phasing adequately all driving signals to support the underlying mode shape of the resonance, energy is accumulated in the resonance of the acoustic generator 200. In this manner, the acoustic generator 200 also forms an acoustic cavity for energy storage and/or amplification.

In an exemplary embodiment, the acoustic generator 200 is formed of layers 204 of piezoelectric or magnetostrictive materials that can be independently actuated by layers 202 with phases such that the phasing creates and sustains a pressure or acoustic wave within the acoustic generator 200. Maximum output of the acoustic generator 200 can be achieved if the frequency of excitation is at a resonance frequency of the acoustic generator 200. In this way, is it possible to produce a large energy build or output with minimal energy input. In some embodiments, layers of other materials (e.g., steel, lead, etc.) can be interspersed between the piezoelectric or magnetostrictive materials to adjust the resonance characteristics (Q factor, resonance frequency, etc.) of the acoustic generator 200. In some embodiments, the acoustic generator 200 can be shaped as a cylinder, bar, ellipsoid, or any other one-, two-, or three-, etc., dimensional shape (e.g., planar, spherical, etc.) depending on the types of waves (frequency, wavelength, amplitude, etc.) that are to be generated. The metamaterial may be configured as a matrix of cells and/or a lattice structure. Moreover, the acoustic generator may be formed of a coiled or wound structure to enable a reduced size and/or volume of the acoustic generator while maintaining the low input-high output aspects of the invention.

Those of skill in the art will appreciate that in some embodiments a third layer formed of one or more layers of material may be provided and/or configured within the acoustic generator to provide additional materials that are optimized for energy storage. The third layer may be formed of a material with a high Q Factor that is configured to have a low rate of energy loss relative to the energy generated and stored within the acoustic generator. For example, the third layer may include, but not be limited to, silicon, photonic crystals, quartz and other silica based compounds, lead zirconate titanate, tourmaline, aluminum nitride, Gallium nitride, Zinc oxide, diamond, etc. Further, those of skill in the art will appreciate that the selection of material for the first and/or second layers described above may be configured to provide the storage capability, and thus a third layer is optional.

Figure 3:
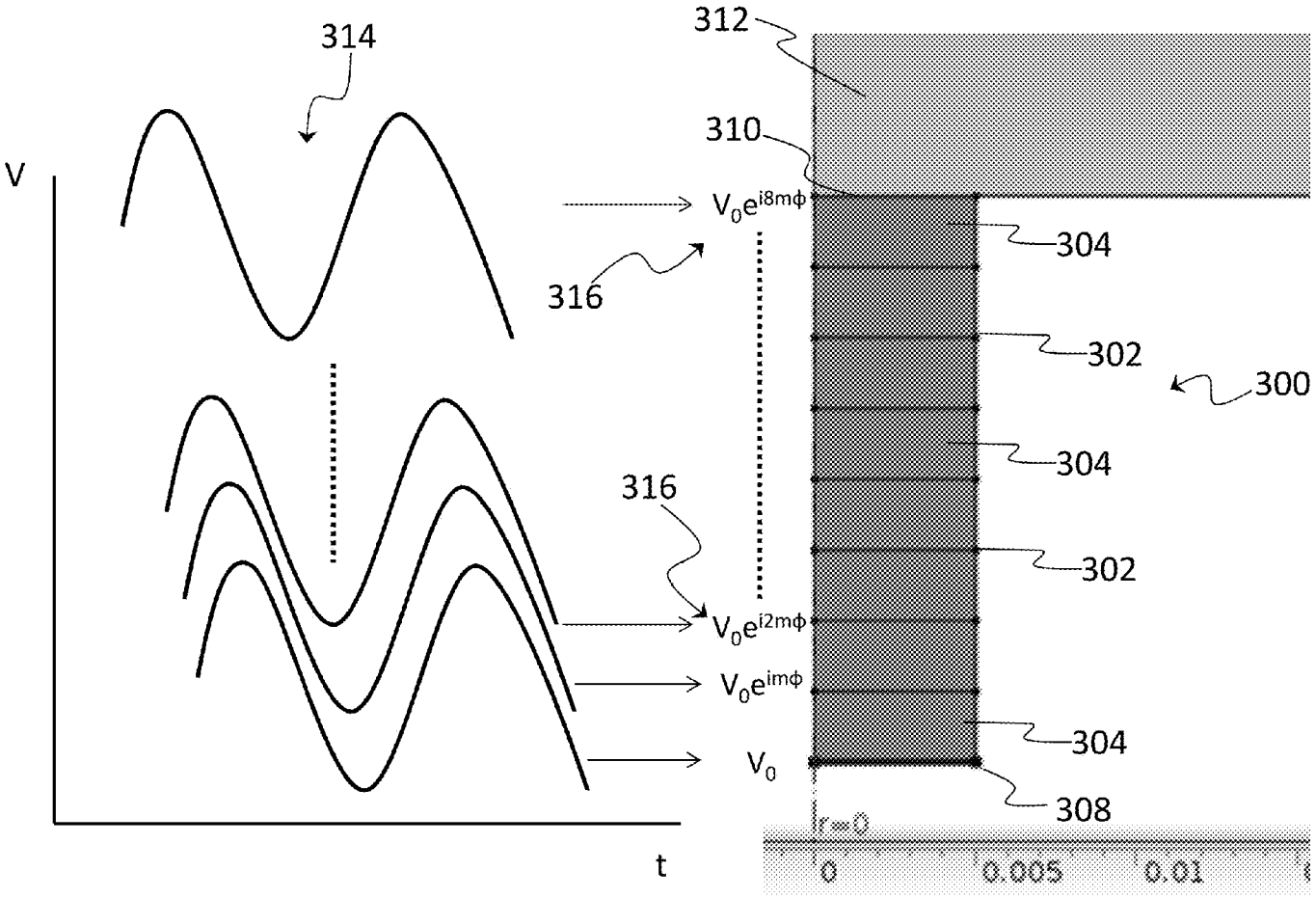
FIG. 3 shows a schematic of the operation of an acoustic generator in accordance with an exemplary embodiment of the invention.

Turning now to FIG. 3, a schematic example of an acoustic generator 300 in accordance with embodiments of the invention is shown. Acoustic generator 300 is formed as a stack of a plurality of first layers 302 which are configured as electrodes and a plurality of second layers 304 which are configured as electromagnetic responsive materials, such as described above and may be substantially similar to acoustic generator 200 of FIG. 2. The acoustic generator 300 includes a base or first end 308 and a gate 312 or other similar device is provided at a top or second end 310 of the acoustic generator 300. Energy generated within the acoustic generator 300, such as acoustic energy generated by the actuation of second layers 304, can be stored, retained, and/or accumulated within the acoustic generator 300 by energy and/or wave reflection within the acoustic generator 300 between the base 308 and the gate 312, when the gate 312 is in a closed position. To achieve this, base 308 and gate 312 (in the closed position) at top 310 are configured to be reflective surfaces and/or interfaces for the mechanical/acoustic energy that is generated within the acoustic generator 300.

In operation, a plurality of excitation levels are provided to the various electrode first layers 302. As shown, a plurality of waveforms 314 of different voltages can be provided, such that increasing voltages can be provided from the base 308 to the top 310 of the first layers 302 within acoustic generator 300 and imparted to the second layers 304. For example, a base voltage $V_0$ may be provided to an electrode layer 302 located at the base 308. Then, at the next electrode first layer 302 within the acoustic generator 300, a second voltage $V_0e^{im\Phi}$ may be applied. Next, a higher voltage $V_0e^{i2m\Phi}$ may be applied to the next sequential electrode first layer 302. The increased voltage levels may be sequentially applied to each first layer 302 within the acoustic generator 300. For example, in FIG. 3, there are nine first layers 302 shown, starting at base 308 at a voltage level of $V_0$ and building or progressing to a first layer 302 at the interface between the acoustic generator 300 and the gate 312 at a voltage level of $V_0e^{i8m\Phi}$. Each voltage application may have a different phase excitation for each layer to thus create a resonance wave within the acoustic generator 300. In addition to different voltages and/or phases, those of skill in the art will appreciate that the dimensions, shapes, sizes, configurations, etc., of the second layers 304 may be configured such that a specific resonant frequency may be achieved.

Figure 4A:
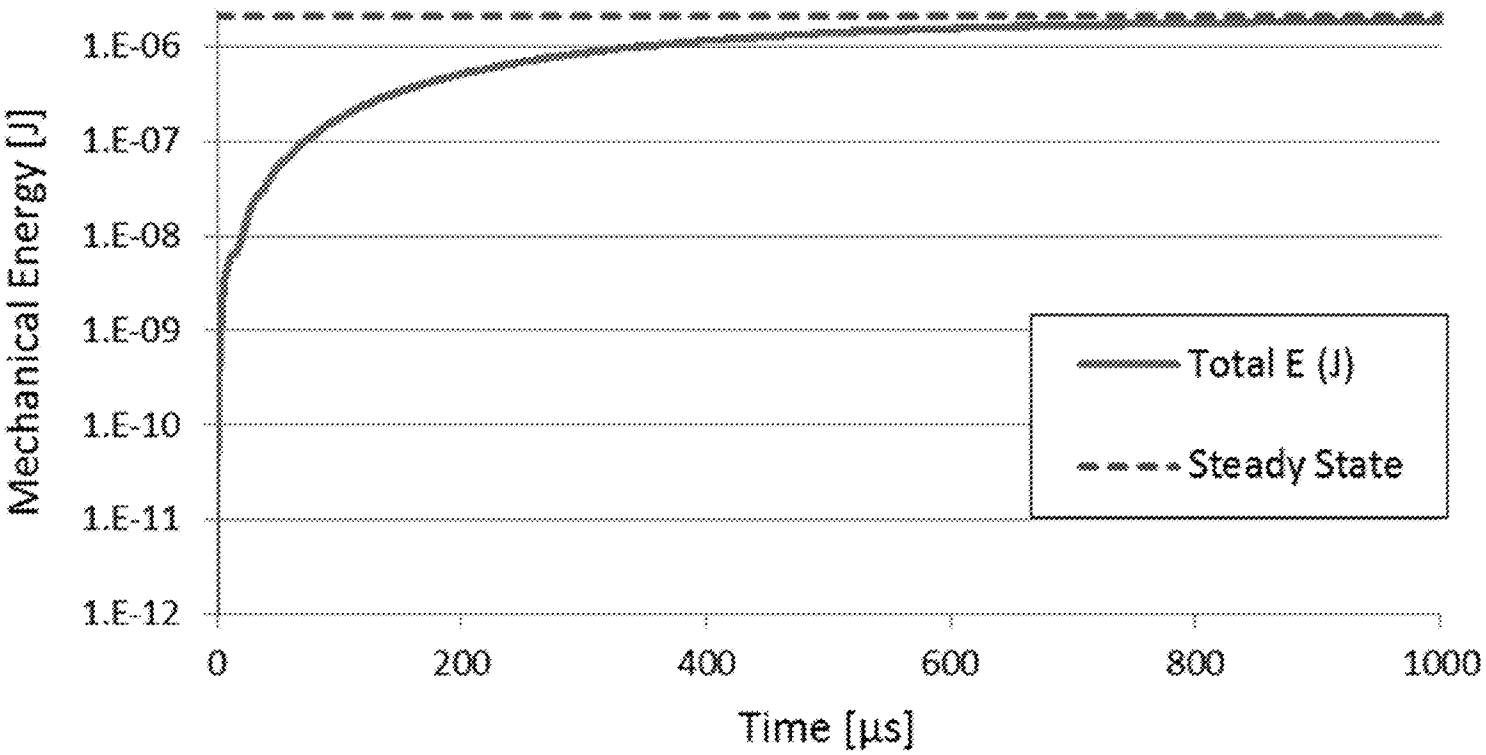
FIG. 4A is a plot of exemplary data of the mechanical energy accumulation in acoustic generators in accordance with the invention.
Figure 4B:
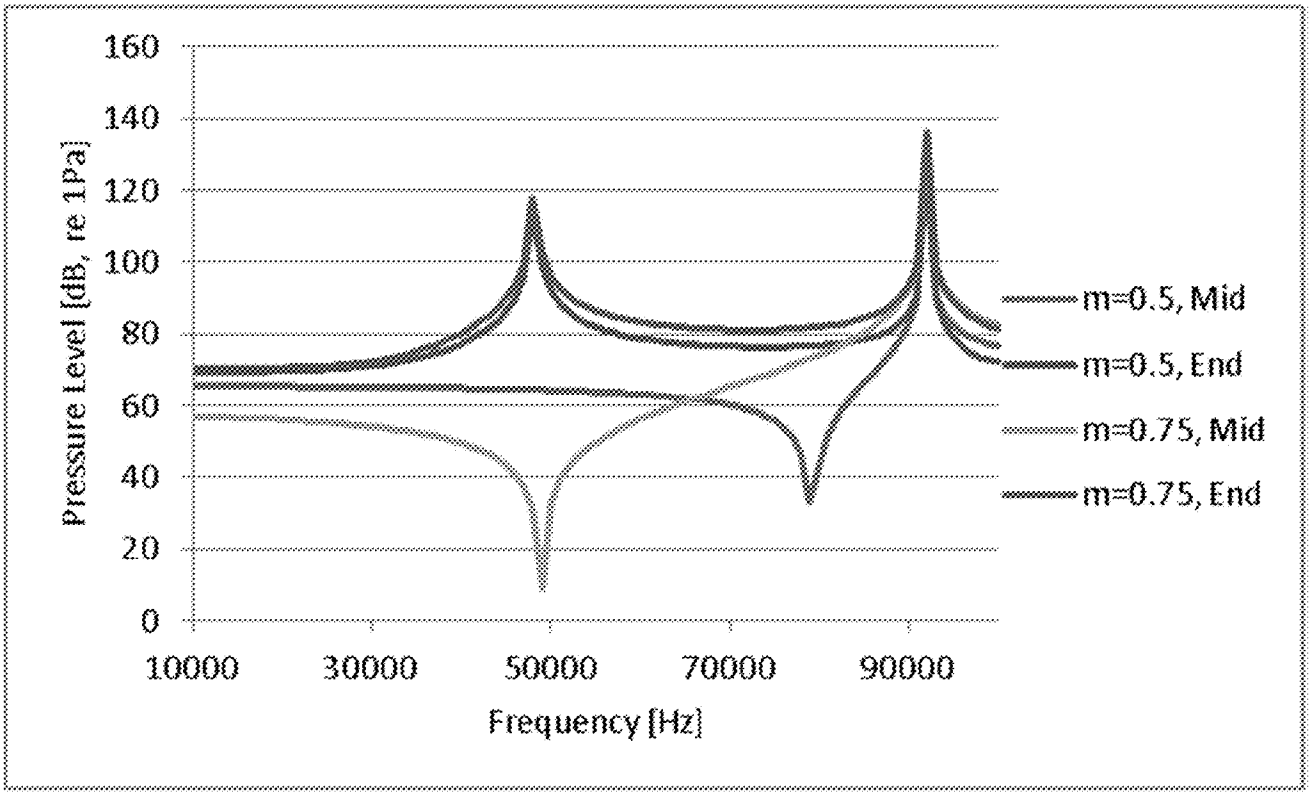
FIG. 4B is an exemplary plot of generator pressure levels at various exemplary frequencies in accordance with the use of acoustic generators in accordance with the invention.

For example, time-domain finite element model predictions illustrate the accumulation of mechanical energy as demonstrated in FIG. 4A when using acoustic generators such as acoustic generators 200, 300. In FIG. 4A, the horizontal axis is the time domain in micro-seconds ("μs") and the vertical axis is mechanical energy in Joules ("J"). At each cycle, potentially on the order of tens of microseconds, a small amount of electrical energy, e.g., 100 mW, 1W, etc., is brought into the system, and is converted into mechanical energy which adds to the mechanical energy already in the generator. Turning now to FIG. 4B, a plot of frequency in hertz (Hz) along the horizontal axis and pressure level in dB, re 1 Pa is shown. As shown there are high pressure waves at resonance frequencies for a low power input, which can thus result in a high power output. Thus, as pressure increases, resonance increases, and the two build upon each other to increase the energy within the acoustic generator.

Equilibrium is reached when the amount of electrical (mechanical) energy pumped into the acoustic generator corresponds to the energy lost by the acoustic generator at each cycle. Losses are a function of the material losses and the energy leakage into components connected to the actuator. Advantageously, even in a sample testing that employed a material with relatively high losses, when the stored energy was released in one cycle the peak power demand was estimated to be over thirty times smaller than the peak power demand of a system without energy storage.

To release the energy that is stored or accumulated within the acoustic generator, the gate may be transitioned from a closed position or state to an open position or state. As noted above, when the gate is in the closed state it is configured to form a reflective surface or interface between the gate and the acoustic generator, thus containing energy within the acoustic generator. However, when the gate is in the open state, the acoustic energy may be transmitted through the gate and into the environment, i.e., be emitted or transmitted. In some embodiments, as noted above, a horn may be located sequentially after the gate and configured to enable modification of the energy transmitted from the actuator in an effort to maximize energy transmission between the acoustic wave generator and the environment. For example, a horn in accordance with embodiments of the invention can be configured to provide radiation control and/or focusing, e.g., impedance matching, of the transmitted energy to enable an efficient energy transfer between the mediums.

The gate may be configured to operate in more than just an open and closed state, i.e., more than just a binary configuration. For example, the gate may be configured to exist in a variety or various states that range between open and closed. In such configurations, the gate may be configured to operate in states that permit amplitude modulation of the acoustic energy. Thus, one or more third or intermediary states may be configured in some embodiments to enable amplitude modulation.

Figure 5:
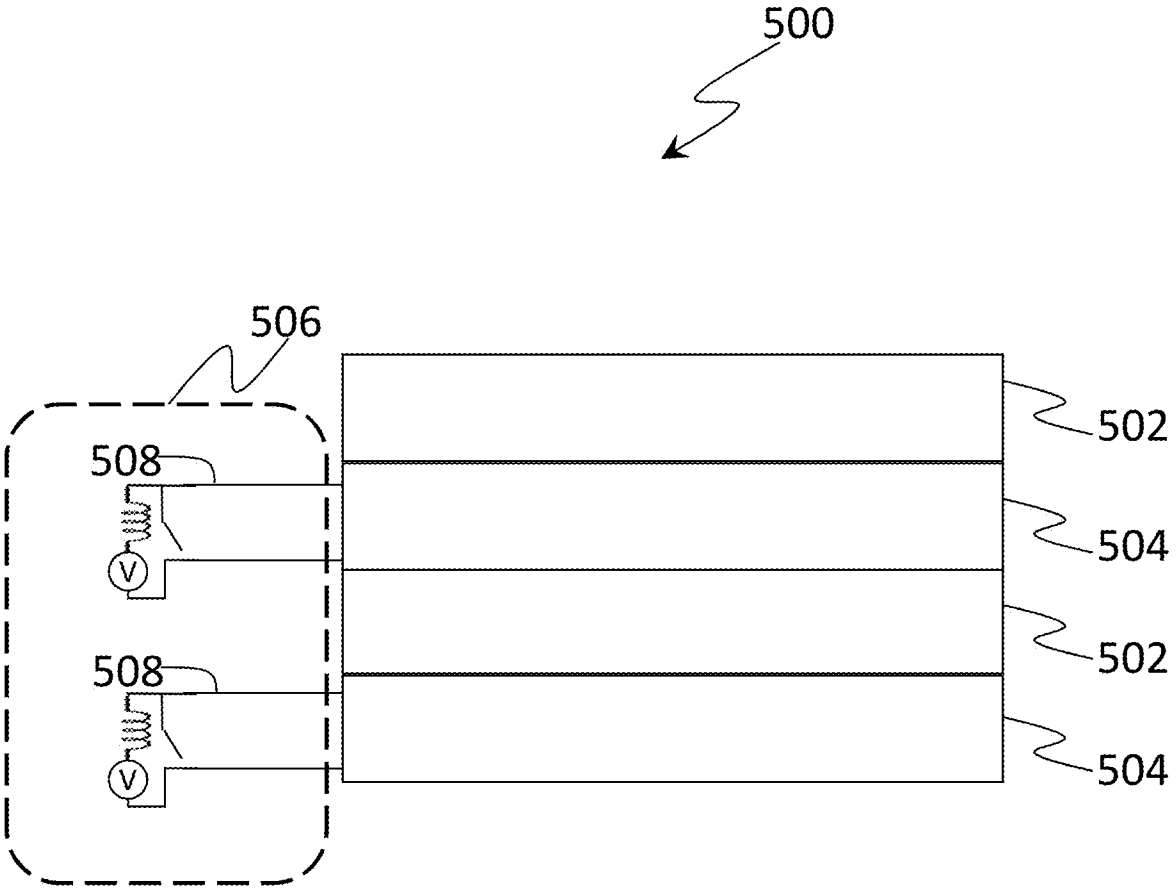
FIG. 5 is a schematic of an acoustic gate in accordance with an exemplary embodiment of the invention.

Turning now to FIG. 5, a schematic of an acoustic gate 500 in accordance with an exemplary embodiment of the invention is shown. The acoustic gate 500 acts as a valve that switches between a first state and a second state by switching between being a highly reflective boundary (preventing the acoustic energy from passing through the gate) and being acoustically transparent (letting acoustic energy through the gate). Thus, for example, the first state may be a closed state in which acoustic energy may not pass through the gate, and the acoustic energy is reflected back into the acoustic energy source, for example at the second end 310 of acoustic wave generator 300 shown in FIG. 3. In the first state the device may be in a storage or amplification period wherein acoustic energy is generated, amplified, and stored within the acoustic wave generator. The second state may be an open state in which acoustic energy may pass through the acoustic gate 500 and be transmitted from the device or acoustic wave generator. As will be appreciated by those of skill in the art, the acoustic gate 500 and in accordance with various embodiments of the invention may be similar to a "Q-switch" used in a pulsed laser.

In the exemplary embodiment of FIG. 5, the acoustic gate 500 is constructed of one or more active metamaterial layers that are switched between the first state and the second state, i.e., between being acoustically reflective and acoustically transparent. As shown in FIG. 5, the acoustic gate 500 may be formed of various first layers 502 and second layers 504, and a plurality of groups of first and second layers 502, 504 can be configured to achieve an appropriately reflective surface or interface when in the closed state and an appropriately transmissive surface or interface when in the open state.

Thus, in some embodiments, to achieve the above characteristics, the metamaterials used herein for the layers 502 and/or layers 504 of acoustic gate 500 are selected materials that exhibit negative refractive indices. For acoustic and elastic wave phenomena, such negative indices yield stopbands, i.e., frequency ranges over which acoustic waves do not propagate through the material and are reflected away as the result of local resonances in the metamaterial. Thus, the acoustic energy or waves generated by an acoustic generator, such as acoustic generator 104, 200, 300, can be reflected back into and contained within the acoustic generator and amplified and/or stored, prior to transmission.

Thus, an aspect of the materials of the layers 502 and/or layers 504 of the acoustic gate 500 is the ability to change material mechanical properties on demand in order to tune or detune local resonances, i.e., to go from a locally resonant state that reflects incoming waves to a locally non-resonant state that lets energy through. For example, a mechanical property that may be changed is the bulk modulus of the material, although other aspects and/or characteristics may be changed without departing from the scope of the invention. In accordance with some embodiments of the invention, the tuning may be provided by the application of electrical and/or magnetic energy. Those of skill in the art will appreciate that other modifications and/or tunable aspects/characteristics may be used without departing from the scope of the invention. For example, in addition to or alternatively to changing or modifying local resonances, tuning of the metamaterial may include changing or modifying the speed of sound within the material, e.g., through stiffness control.

As shown in FIG. 1, the gate 106 may include varying layers. For example, with reference to FIG. 5, the first layers 502 may be piezoelectric material layers and the second layers 504 may be aluminum discs. The combination of the two types of layers may be configured to most efficiently block acoustic energy transmission. In FIG. 5, the second layers 504 may be configured in electrical communication with a controller 506 that may include one or more electrical circuits 508. As noted, the materials of the layers may be metamaterials, non-metamaterials, and/or combinations thereof that are selected to achieve the desired properties and characteristics.

In some embodiments, the controllable and instantaneous switch in the mechanical properties of the metamaterial is achieved by using electromechanical materials in the gate and coupling these electromechanical materials with a controller. Thus, the layers 502, 504 are operationally connected with a controller 506 and electrical circuits 508 thereof, which may be electrically connected to the second layers 504. The electromechanical materials may be, for example, piezoelectric materials, magnetostrictive materials, silicon, photonic crystals, quartz and other silica based compounds, lead zirconate titanate, tourmaline, aluminum nitride, Gallium nitride, Zinc oxide, and/or diamond. For example, in one exemplary embodiment, the first layer 502 may be phononic crystals and/or other types of periodic structures and operate as the active element of the acoustic gate 500. Phononic materials have locally resonant structures with sub-wavelength dimension and having a negative bulk modulus. The phononic materials can be configured to be stopbands such that no acoustic energy is transmitted through the material in a specific state.

In some embodiments, controller 506 may be an electronic circuit with control logic stored therein or configured therewith. Simple or complex control algorithms may be performed using the controller 506. A controller configured with control logic may advantageously provide improved gate performance. For example, the control logic may be configured to improve commuting speed, rejection rate, etc., of the gate.

In some embodiments, the controller 506 and/or electrical circuits 508 may be configured with mechanical and/or electrical dissipation or dampening circuits. In such configurations and embodiments, energy leakage through the acoustic gate 500 may be dampened, reduced, minimized, or eliminated. Further, during switching of states of the acoustic gate 500, energy leakage and/or dissipation may be reduced, minimized, dampened, or eliminated through use of a controller 506 and/or electrical circuits 508 configured with mechanical and/or electrical dissipation or dampening circuits. Such dissipation and/or dampening circuits are not shown for clarity, but would be configured as known in the art.

The second layers 504 may be formed from aluminum discs and the electrical circuits 508 of controller 506 may be in electrical communication with the second layers 504. Because a piezoelectric element acts as a capacitor with capacitance C, coupling it to an inductor L in the controller 506, creates an LC circuit. Bypassing the inductor of the controller 506 changes the resonance frequency of the circuit and, therefore, the local resonance of the metamaterial layers 502, 504 and the state of the acoustic gate 500. In some embodiments, control may be achieved through inductor shunting, voltage biasing, or other processes and means for manipulating the status or states of the material of the layers 502, 504 of the gate.

Thus, embodiments of the invention provide an acoustic gate having a closed position or first state that reflects acoustic waves ("energy") and an open position or second state that lets acoustic energy propagate therethrough. In some embodiments of the invention, the gate is made of or includes an active metamaterial. The state of the gate is permuted, altered, controlled, etc., by changing material properties of the metamaterial through the application of electrical and/or magnetic energy, or other types of energy/power. The alteration of the material properties of the metamaterial of the gate enables "tuning" of the material to, in one instance, have the acoustic gate be closed and, in another instance, have the acoustic gate be open. The switching may be substantially instantaneous because of the use of electrical controllers. Thus, various embodiments of the invention enable a fast, controlled, and concentrated release of acoustic energy from an acoustic wave generator.

As discussed, by tuning the material of the acoustic gate, the metamaterial may achieve a state that prevents or stops acoustic energy from passing therethrough or preventing substantially all of the energy from passing therethough. For example, the metamaterial of the acoustic gate may be tuned to stop or prevent acoustic energy that is propagating at a specific and/or constant frequency. Further, the material of the acoustic gate may be tuned to permit acoustic energy of the same specific and/or constant frequency to pass through the acoustic gate. Furthermore, the tuning enables modulation and/or control of various states between the open and closed state. Thus, acoustic gates in accordance with embodiments of the invention can be configured to control the output of an acoustic wave generator from no output, to partial output, to full output, and can also provide amplitude modulation of the acoustic energy.

Figure 6:
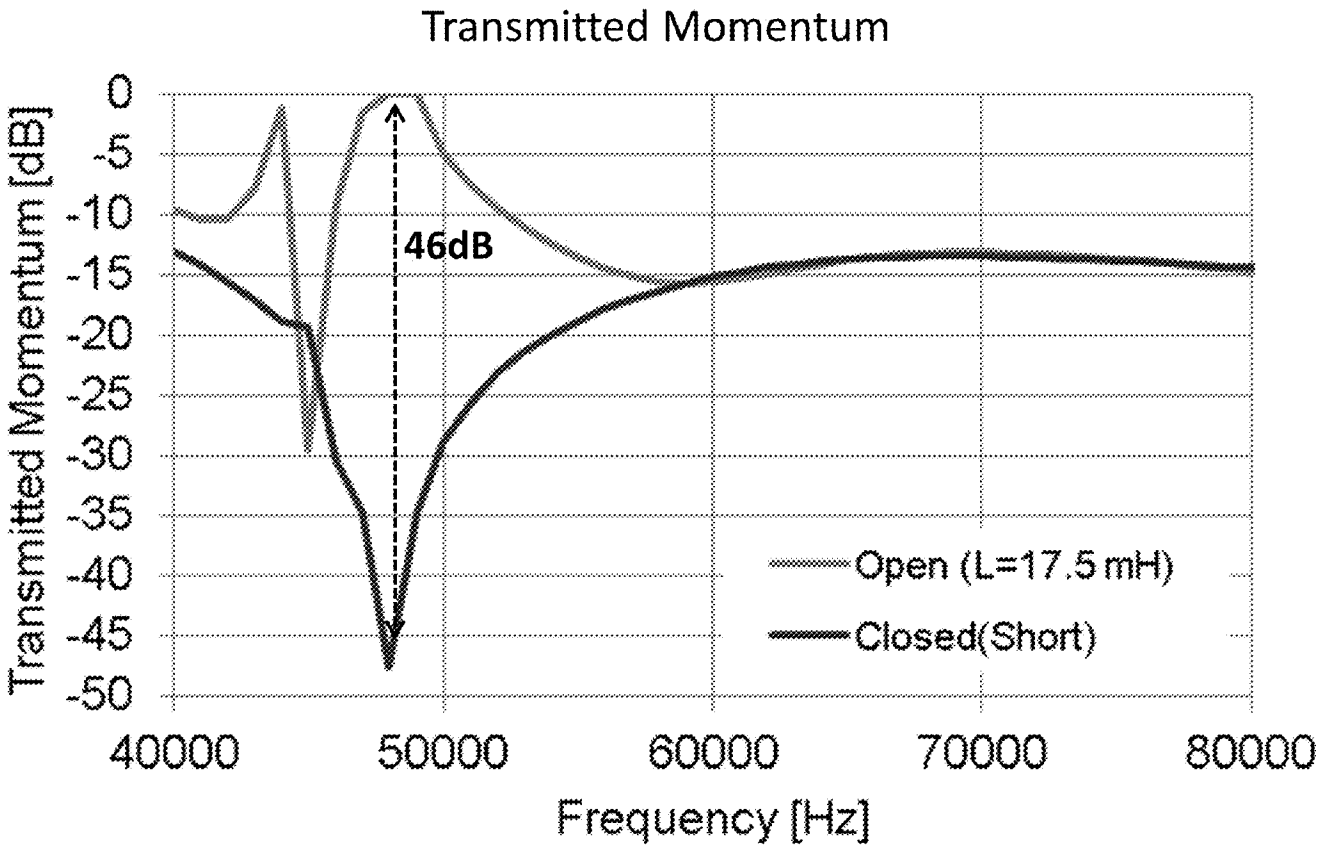
FIG. 6 is an exemplary plot of the calculated transmitted momentum through an acoustic gate in accordance with an embodiment of the invention.

Turning now to FIG. 6, an example of the calculated transmitted momentum through a metamaterial gate in accordance with an embodiment of the invention is presented. The acoustic gate employed for this sampling is similar in construction to that shown in FIG. 5, wherein there are two cells of one-dimensional periodic structure, with each cell having a first layer 502 and a second layer 504, and a controller 506 with two control circuits. In this particular example and gate design used for simulation and sampling is most reflective in the closed state at 47 kHz. Thus, a 47 kHz signal or source was supplied and transmitted toward the gate.

The metamaterial gate in accordance with this embodiment of the invention achieved 46 dB of transmission loss at the tuning frequency of 47 kHz, as shown in FIG. 6. In addition, the acoustic gate of this sample achieved over 40 dB attenuation over a 2 kHz range, providing 5% bandwidth that can enable fine tuning of the acoustic gate with the resonance of the acoustic wave generator, and energy storage and amplification was achieved on the order of about 200 microseconds, by using acoustic wave generators such as that shown in FIGS. 1-3. When the gate was in the closed position, 99.997% of the incoming acoustic wave is reflected back toward the source of the acoustic energy. This substantial stopband was achieved with only two cells. Those of skill in the art will appreciate that various number of cells may be employed in construction of acoustic gates in accordance with the invention and a greater number of cells may be provided to improve reflectivity.

Although the above example has been described with respect to a one-dimensional periodic structure, those of skill in the art will appreciate that other configurations are possible without departing from the scope of the invention. For example, any one-, two-, three-, etc., dimensional configuration and/or structure may be used without departing from the scope of the invention. As such, the acoustic metamaterial of the gate may be formed or configured as a matrix of cells or may have a lattice structure.

Advantageously, in accordance with various embodiments of the invention, an acoustic wave generator is provided that enables low energy consumption when generating and/or transmitting acoustic waves. Further, in accordance with some embodiments, the acoustic generator of the acoustic wave generator functions as an energy storage device and energy amplifier such that minimal energy needs to be input to generate a high energy output. Advantageously, this energy storage mechanism and release has the potential to reduce the peak power needs of the system. For example, the reduction in peak power needs may be about thirty to fifty times less when compared to the energy needed over one cycle for a transducer without energy storage. Moreover, advantageously, short duration power pulse acoustic transduction in accordance with embodiments of the invention may enable a new class of low observable underwater intelligence, surveillance and reconnaissance, and communication devices, by focusing acoustic energy into a dedicated spectral band receiver while employing a small scale device.

Further, advantageously, in accordance with some embodiments of the invention, an acoustic generator employs and exploits synchronous excitation to accumulate energy at resonance, rather than using stimulated emission. This difference profoundly alters the operation of the transducer/actuator, and permits much lower frequency range of excitation, potentially down to about 100-500 Hz or lower, making this technology suitable for underwater acoustic communication and detection.

Furthermore, advantageously, because acoustic generators in accordance with some embodiments are configured to be controlled, in part, by the application of electromagnetic input, the actuator may be tunable such that a single device of small construction and packaging can be provided to generate acoustic waves at various predetermined frequencies, for example between 100 Hz to 500 kHz, although other frequencies and/or ranges are possible.

Furthermore, advantageously, by using metamaterials for the construction of the acoustic gate in accordance with embodiments of the invention, the acoustic gate can reflect or release acoustic and pressure waves in a solid. Further, fast switching of the material is enabled by means of, for example, electronic switching. Moreover, the electronic switching of the gate provides a high reliability in terms of operation. Furthermore, gates in accordance with embodiments of the invention provide an energy efficient solution because in one state (open or closed), the gate does not require any control, such as a supply of electrical current. Moreover, advantageously, small packaging and/or devices are enabled by means of the gates disclosed herein.

The integrated use of more than one acoustic gate can enable steering of the energy or acoustic waves. That is, a device in accordance with embodiments of the invention may be configured to steer acoustic energy across various paths and/or through various gates. Thus, although shown herein as a single gate, those of skill in the art will appreciate that multiple gates may be used without departing from the scope of the invention.

Advantageously, the ability to store and subsequently release acoustic energy or other types of pressure waves is provided herein. Energy can be built up and released as enabled by the characteristics of the acoustic generator and the acoustic gate disclosed herein. Various applications are enabled by the configurations disclosed and claimed herein. For example, sonic devices in accordance with embodiments of the invention that use acoustic wave generation may be used in detection applications, health care industry, including high power ultrasonics for non-invasive surgery and/or imaging, gas leak sensing, underwater sonar devices, and/or for other uses.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments and/or features.

For example, although various embodiments have been described above with specific numbers of layers or features, those of skill in the art will appreciate that these numbers are merely presented for exemplary and explanatory purposes and the numbers and configurations may be changed without departing from the scope of the invention. Further, although described herein as employing piezoelectric layers, those of skill in the art will appreciate that other types of layers may be used without departing from the scope of the invention. For example, any material that can be actuated or induced to change mechanical properties and thus generate energy, including but not limited to magnetostrictive materials, may be used without departing from the scope of the invention.

Further, for example, with respect to the sample presented along with FIG. 6, the dimensions, sizes, numbers, and results are merely presented for exemplary and explanatory reasons. The energy blockage percentage, for example, may be greater or less than the stated 99.997% energy blockage, without departing from the scope of the invention. In fact, the energy blockage may be of any percentage, but those of skill in the art will appreciate that a higher percentage of blockage enables more efficient energy production, amplification, storage, and transmission. Furthermore, although described with respect to a specific frequency, those of skill in the art will appreciate that different frequencies may be configured or targeted and further that predetermined frequency ranges, discrete values, or combinations of discrete values may be achieved without departing from the scope of the invention.

Further, although disclosed herein as a one-dimensional metamaterial, those of skill in the art will appreciate that acoustic generators and gates in accordance with the invention may be formed of two-dimensional, three-, or other-dimensional structures. For example, the metamaterials used herein may be formed with a matrix of cells and/or lattice structures in two-, three-, or other-dimensions. Thus, the invention is not limited to a one-dimensional configuration.

Further, although described herein with the acoustic horn and the acoustic gate as separate elements, those of skill in the art will appreciate that the acoustic horn may be formed or constructed integrally with the acoustic gate.

Accordingly, the invention is not to be seen as limited by the foregoing description, but is only limited by the scope of the appended claims.

What is claimed is:

1. An acoustic wave gate comprising:

one or more layers of metamaterial configured to be in a first state and a second state and configured to change from the first state to the second state when electrical and/or magnetic energy is applied thereto; and at least one source configured in operational communication with the one or more layers and configured to supply at least one of electrical and magnetic energy to the one or more layers, wherein the one or more layers are configured to (i) prevent the passage of acoustic energy through the one or more layers when in the first state and (ii) permit the passage of acoustic energy through the one or more layers when in the second state, wherein the one or more layers are configured to be stimulated in phase with the acoustic energy.

2. The acoustic gate of claim 1, further comprising one or more electrodes disposed between the one or more layers, the one or more electrodes in electrical communication with the at least one source, and the one or more electrodes configured to provide the operational communication between the at least one source and the one or more layers.

3. The acoustic gate of claim 1, wherein the one or more layers comprise an electromechanical material.

4. The acoustic gate of claim 3, wherein at least one layer of the one or more layers comprises a piezoelectric ceramic or a piezoelectric crystal.

5. The acoustic gate of claim 1, wherein the one or more layers comprise a plurality of layers configured into cells.

6. The acoustic gate of claim 1, wherein the metamaterial comprises at least one of a matrix of cells and a lattice structure.

7. The acoustic gate of claim 1, further comprising an acoustic wave generator configured in acoustic communication with the gate and configured to transmit acoustic energy through the gate when the gate is in the second state.

8. The acoustic gate of claim 1, wherein the one or more layers are configured to reflect acoustic energy that is incident to the layers.

9. The acoustic gate of claim 1, further comprising an acoustic horn disposed adjacent to the one or more layers and configured to modify an acoustic impedance of acoustic energy that is transmitted through the acoustic gate.

10. The acoustic gate of claim 9, wherein the acoustic horn is configured to match an impedance of the acoustic energy transmitted through the gate with an impedance of a material into which the acoustic energy is to be transmitted.

11. The acoustic gate of claim 1, wherein the one or more layers are configured to operate as an acoustic horn.

12. The acoustic gate of claim 1, further comprising at least one third state of the one or more layers of metamaterial configured to enable amplitude modulation of acoustic energy that passes through the one or more layers.

13. The acoustic gate of claim 1, further comprising one or more mechanical and/or electrical dissipation circuits configured to control energy leakage through the gate.

14. A method of transmitting acoustic energy comprising:

generating acoustic energy with an acoustic energy source;

blocking the generated acoustic energy from leaving the acoustic energy source with an acoustic gate in a first state; and controlling the acoustic gate to change to a second state that permits the acoustic energy to pass through the acoustic gate and be emitted to an environment.

15. The method of claim 14, wherein the acoustic gate is formed from metamaterials.

16. The method of claim 14, further comprising:

during the blocking step, reflecting the acoustic energy back into the acoustic energy source.

17. The method of claim 14, further comprising altering the acoustic impedance of the acoustic energy to match an acoustic impedance of a material into which the acoustic energy is to be transmitted.

18. The method of claim 14, further comprising modulating the amplitude of the acoustic energy prior to emission of the acoustic energy.

19. The method of claim 18, wherein the step of modulating includes a state of operation that is between the first state and the second state.

20. The method of claim 14, further comprising dampening energy leakage through the gate.

* * * * *